United States Patent [19]

Lee

[11] Patent Number: 4,826,715

[45] Date of Patent: May 2, 1989

[54] INFLATABLE ARTICLE WITH A REINFORCED CORD

[76] Inventor: Michael Lee, 22011 Heidi Ave., El Toro, Calif. 92630

[21] Appl. No.: 146,400

[22] Filed: Jan. 21, 1988

[51] Int. Cl.[4] ..... B32B 7/08

[52] U.S. Cl. ..... 428/65; 428/98; 5/458

[58] Field of Search ..... 428/65, 98; 5/458

[56] References Cited

U.S. PATENT DOCUMENTS 948,644 2/1910 Bjornstad ..... 5/458

1,627,835 5/1927 Combs ..... 5/458

1,986,697 1/1935 Wilson ..... 5/449

*Primary Examiner*—Alexander S. Thomas

*Attorney, Agent, or Firm*—Cushman, Darby & Cushman

[57] ABSTRACT

An inflatable article has first and second impermeable members which are made of a flexible material. The first and second impermeable members are joined together at their edge portions to define an air chamber therebetween. A plurality of first retaining elements are attached to the inner surface of the first impermeable member. A plurality of second retaining elements are attached to the inner surface of the second impermeable member. An endless flexible cord is retained alternately on the first and second retaining elements.

5 Claims, 3 Drawing Sheets

INFLATABLE ARTICLE WITH A REINFORCED CORD

BACKGROUND OF THE INVENTION

This invention relates to an inflatable article, and more particularly to one which has a reinforced cord.

To reinforce an inflatable article, refering to FIG. 1, vertical plastic bands 13 are connected between an upper impermeable member 11 and a lower impermeable member 12 by high frequency technique. Or, referring to FIG. 2, tubular plastic elements 14 are connected between the upper and lower impermeable members. When the inflatable article is used, however, the bands 13 and the tubular elements 14 will be pressed and thus deformed, as shown in FIGS. 3 and 4. The bands 13 and the tubular elements 14 may separate from the upper or lower impermeable member due to stress concentration. The lifetime of the inflatable article is thus decreased.

SUMMARY OF THE INVENTION

It is therefore the main object of this invention to provide a durable inflatable article with a reinforced cord whereby stress cannot concentrate at any portion of the inflatable article when it is being used.

Another object of this invention is to provide a durable inflatable article with a reinforced cord which is always attached to the inner surface of the inflatable article when it is being used.

According to this invention, an inflatable article has first and second impermeable members which are made of a flexible material. The first and second impermeable members are joined together at their edge portions to define an air chamber therebetween. A plurality of first retaining elements are attached to the inner surface of the first impermeable member. A plurality of second retaining elements are attached to the inner surface of the second impermeable member. An endless flexible cord is retained alternately on the first and second retaining elements.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENT

Figure 1:
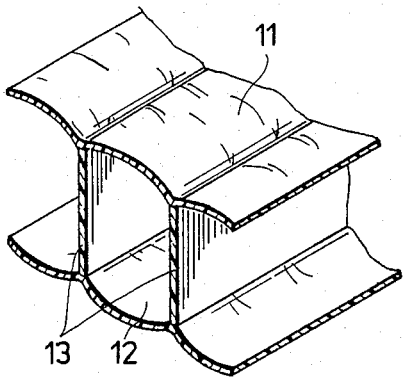
FIG. 1 is a schematic perspective view illustrating how a first conventional inflatable article is reinforced by vertical plastic bands.
Figure 2:
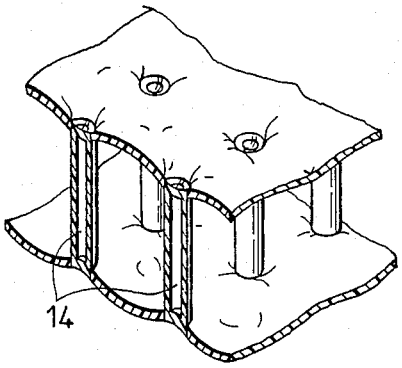
FIG. 2 is a schematic perspective view illustrating how a second conventional inflatable article is reinforced by plastic tubular elements.
Figure 3:
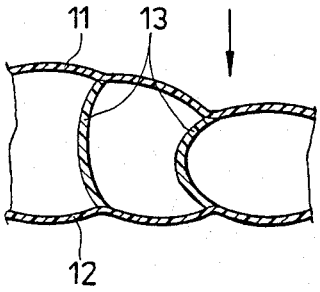
FIG. 3 is a schematic sectional view illustrating the deformation of the vertical plastic bands of the first conventional inflatable article when depressed.
Figure 4:
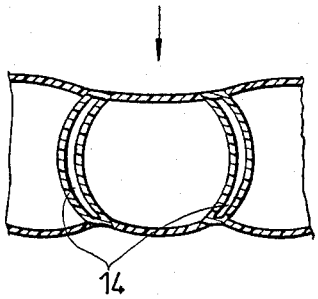
FIG. 4 is a schematic sectional view illustrating the deformation of the plastic tubular elements of the second conventional inflatable article when depressed.
Figure 5:
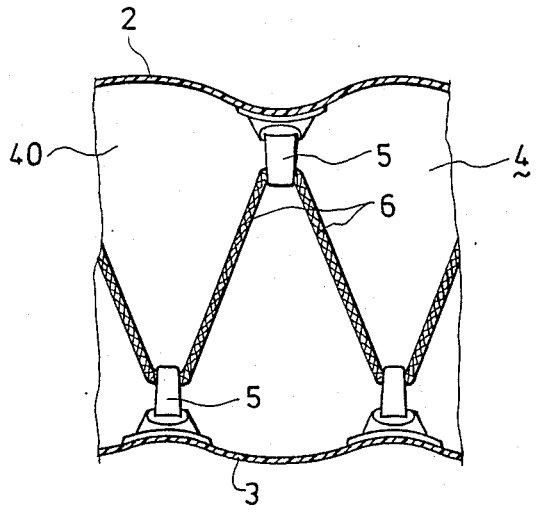
FIG. 5 is a schematic sectional view showing part of an annular mattress according to this invention.
Figure 6:
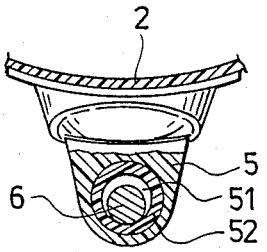
FIG. 6 is a schematic sectional view illustrating the coupling structure of the mattress and a reinforced cord in accordance with this invention.

Referring to FIG. 5, an annular mattress 4 of this invention includes a layer of upper member 2 and a layer of lower member 3 which are made of a transparent plastic material. The upper member 2 and the lower member 3 are joined together at their edge portions by high frequency technique so as to define therebetween an air chamber 40 which is filled with air or gas.

Figure 7:
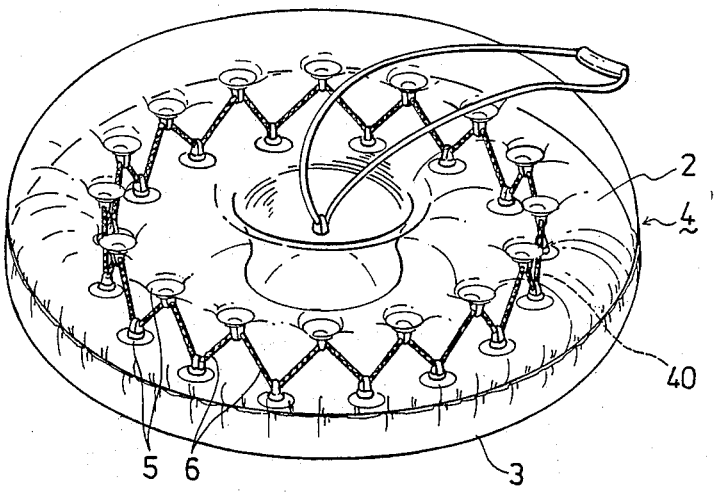
FIG. 7 is a perspective view showing the mattress of this invention.

A plurality of plastic retaining rings 5 are attached to the inner surface of the upper member 2 and the lower member 3 in the same circular arrangement, as shown in FIG. 7. An endless cord 6 is passed through each of the retaining rings 5 and thus forms a serrated circular arrangement. Each of the retaining rings 5 includes a wearproof pad 51 attached to its inner surface so that the cord 6 and the retaining rings 5 will not wear when the cord 6 moves through the retaining rings 5.

With the endless cord 6 interconnecting the upper member 2 and the lower member 3, when the mattress 4 is depressed, the pressure to the mattress 4 is transferred all over the mattress 4 but does not form stress concentration.

With this invention thus explained, it is apparent that numerous modifications and variations can be made without departing from the scope and spirit of this invention. It is therefore intended that this invention be limited only as indicated in the appended claims.

I claim:

1. An inflatable article comprising first and second impermeable members which are made of a flexible plastic material, said impermeable members being joined together at their edge portions to define therebetween a chamber which is filled with air or gas in an air-tight manner, a plurality of first plastic rings connected securely to an inner surface of said first impermeable member by high frequency technique, a plurality of second plastic rings connected securely to an inner surface of said second impermeable member by high frequency technique, each of said plastic rings including a wearproof pad attached to its inner surface, and an endless flexible cord retained alternately on said first and second plastic rings, said cord passing through each of said plastic rings.

2. An inflatable article as claimed in claim 1, wherein said first and second impermeable members are annular, and wherein each of said first and second retaining elements is positioned in a circular arrangement.

3. An inflatable article comprising first and second impermeable members which are made of a flexible plastic material, said impermeable members being joined together at their edge portions to define therebetween a chamber which is filled with air or gas in an air-tight manner, a plurality of first plastic rings connected securely to an inner surface of said first impermeable member, a plurality of second plastic rings connected securely to an inner surface of said second impermeable member, each of said plastic rings including a wearproof pad attached to its inner surface, and an endless flexible cord retained alternately on said first and second plastic rings.

4. An inflatable article as claimed in claim 3, wherein said first and second impermeable members are annular, and wherein each of said first and second retaining elements is positioned in a circular arrangement.

5. An inflatable article as claimed in claim 4, wherein said plastic rings are connected securely to said first and second impermeable members respectively by high frequency technique.

* * * * *